United States Patent [19]

Yamamura et al.

[11] Patent Number: 4,491,127

[45] Date of Patent: Jan. 1, 1985

[54] MASSAGING ELEMENT

[75] Inventors: Yukio Yamamura; Takafumi Hamabe, both of Hikone, Japan

[73] Assignee: Matsushita Electric Works, Ltd., Osaka, Japan

[21] Appl. No.: 413,459

[22] Filed: Aug. 31, 1982

[30] Foreign Application Priority Data

Nov. 5, 1981 [JP] Japan ..... 56-178185

[51] Int. Cl.[3] ..... A61H 15/00

[52] U.S. Cl. ..... 128/57

[58] Field of Search ..... 128/57, 58, 60, 61, 128/25 B, 24.3

[56] References Cited

U.S. PATENT DOCUMENTS

| | | | |
|---|---|---|---|
| 3,067,738 | 12/1962 | Karlik | 128/57 |
| 4,016,872 | 4/1977 | Yamamura et al. | 128/57 |
| 4,412,534 | 11/1983 | Hamabe et al. | 128/52 |

FOREIGN PATENT DOCUMENTS

| | | | |
|---|---|---|---|
| 2639038 | of 1978 | Fed. Rep. of Germany | 128/57 |
| 26526 | of 1953 | Finland | 128/57 |
| 1127127 | of 1956 | France | 128/57 |

*Primary Examiner*—Richard J. Apley
*Assistant Examiner*—David J. Brown
*Attorney, Agent, or Firm*—Burns, Doane, Swecker & Mathis

[57] ABSTRACT

Massaging element for mechanical massaging device comprises an inner ring fixed eccentrically to a main driven shaft and an outer ring fitted around the inner ring through an antifriction bearing, and the outer ring comprises many arcuate and elastic plate-spring parts extending substantially spirally outward as formed integrally with a ring body and a soft material layer formed around the body embedding therein the plate-spring parts. The element initially provides a soft touch to a human body and then gradually harder touches with the modulus of elasticity increased stepwise, whereby a pressing massage action similar to that manually given by a skilled massagist can be obtained.

4 Claims, 10 Drawing Figures

Fig. 7
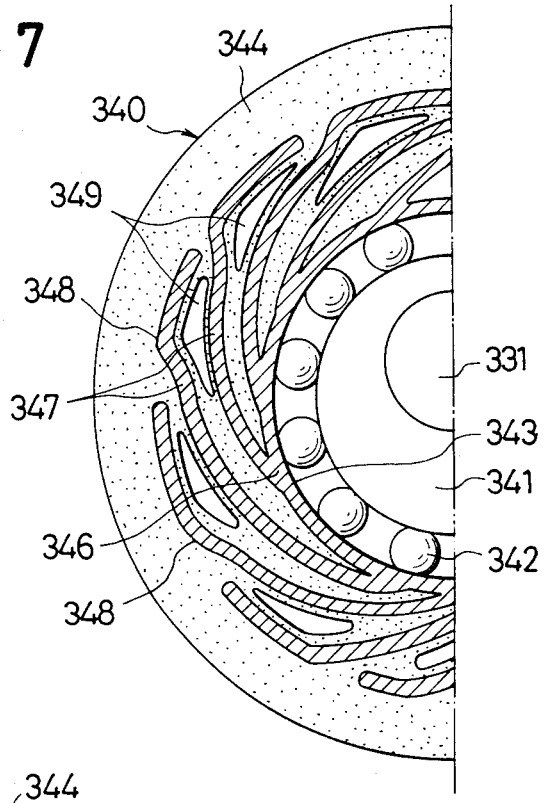
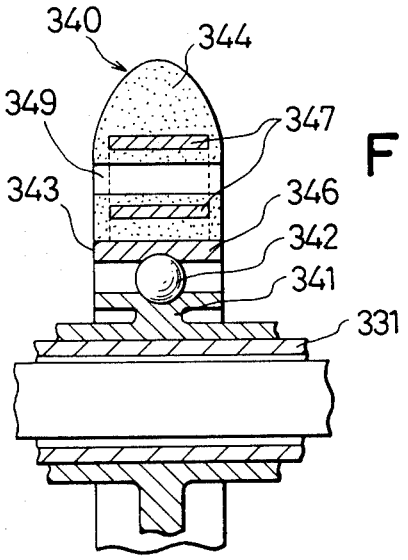
Fig. 6

MASSAGING ELEMENT

This invention relates to massaging elements of devices for massaging human bodies with mechanical means and, more particularly, to a massaging element which can give varying pressing forces to a human body with a single element structure.

Massaging devices adopting massaging elements of the kind referred to have been suggested in, for example, U.S. Pat. No. 4,106,872 (to which French Pat. No. 7,605,283 corresponds) and U.S. Pat. No. 4,412,534 (to which French Patent Application No. 8108583 corresponds), in which the massaging elements of a disk shape are properly eccentrically rotated or displaced so as to provide desired massaging actions, as will be detailed later.

Generally, the massaging element is formed by providing a ball bearing between respectively rigid inner and outer rings so that the both rings can relatively rotate and attaching a soft material to the peripheral surface of the outer ring. In this massaging element, however, there have been such defects that, if the soft material through which the massaging action is given to the human body is made thin, a give touch to the human body will be too hard while, if the soft material is made thick, a resultant pressing force will not reach a sufficient level and, even when the thickness is properly selected, resultant pressing force has been only monotonous.

A primary object of the present invention is, therefore, to provide a massaging element for the massaging devices which can realize a favorable massaging action which providing to the human body initially a soft touch and then harder touches.

Another object of the present invention is to provide a massaging element of a disk shape for the massaging devices which is capable of causing the modulus of elasticity of outer peripheral soft material of the element to be increased stepwise in response to increases in eccentrical projections of the element from its supporting shaft toward the human body.

Still another object of the present invention is to provide a massaging element for the massaging devices which is elastically deformable not only in radial directions but also in axial directions of main supporting shaft.

Other objects and advantages of the present invention shall become clear from the following explanations of the invention detailed with reference to preferred embodiments shown in accompanying drawings, in which:

FIG. 6 is a fragmental section in the same diametral direction of an embodiment of a massaging element according to the present invention;

FIG. 7 is a fragmental section along a plane vertical to the axial direction of the massaging element shown in FIG. 6;

While the present invention shall now be explained in the followings with reference to the embodiments shown in the accompanying drawings, the intention is not to limit the present invention only to these embodiments shown but to rather include all modifications, alterations and equivalent arrangements possible within the scope of appended claims.

First, prior to describing the present invention, an example of the massaging device to which the massaging elements of the present invention are applied shall be explained, in order to have the present invention well understood. However, it will be readily understood that the massaging elements according to the present invention can be adopted not only in the massaging device to be disclosed here but also in such other types of the massaging devices as disclosed in, for example, the above referred U.S. Pat. No. 4,106,872 (or French Pat. No. 7,605,283) and the like.

Figure 1:
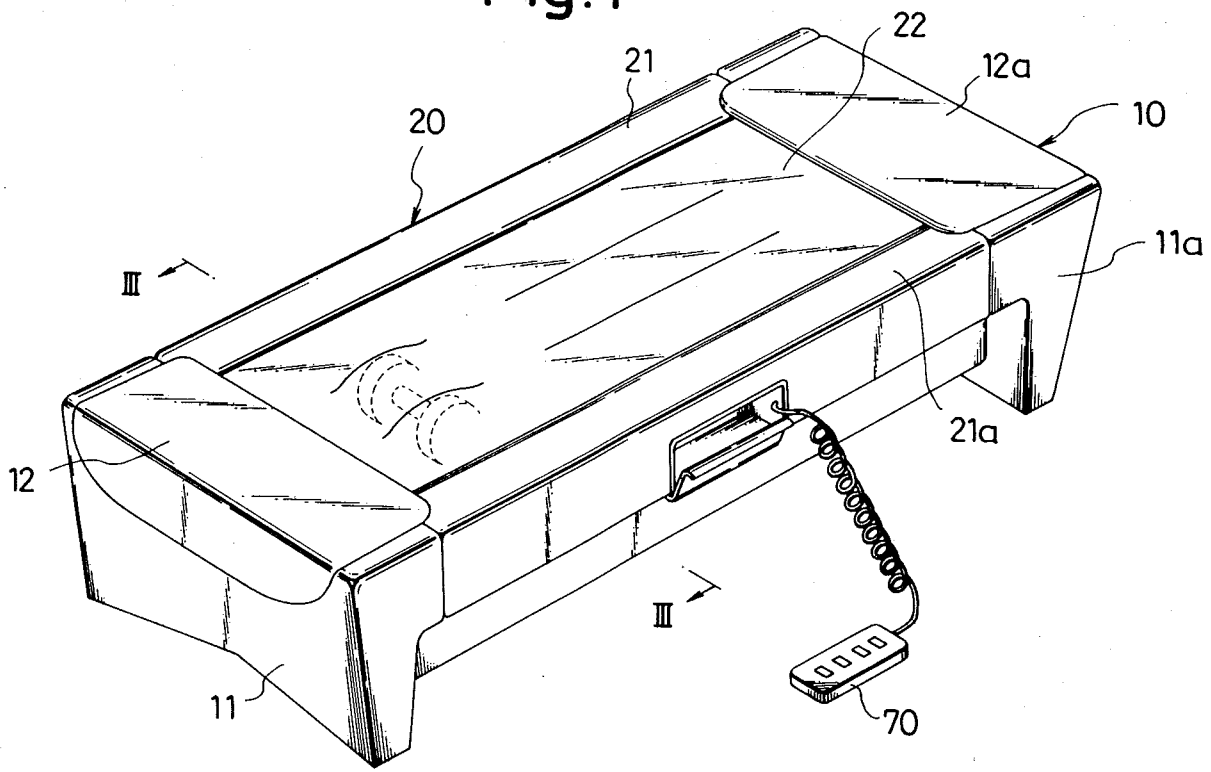
FIG. 1 is a perspective view of an example of a massaging device to which massaging elements according to the present invention are applied.
Figure 2:
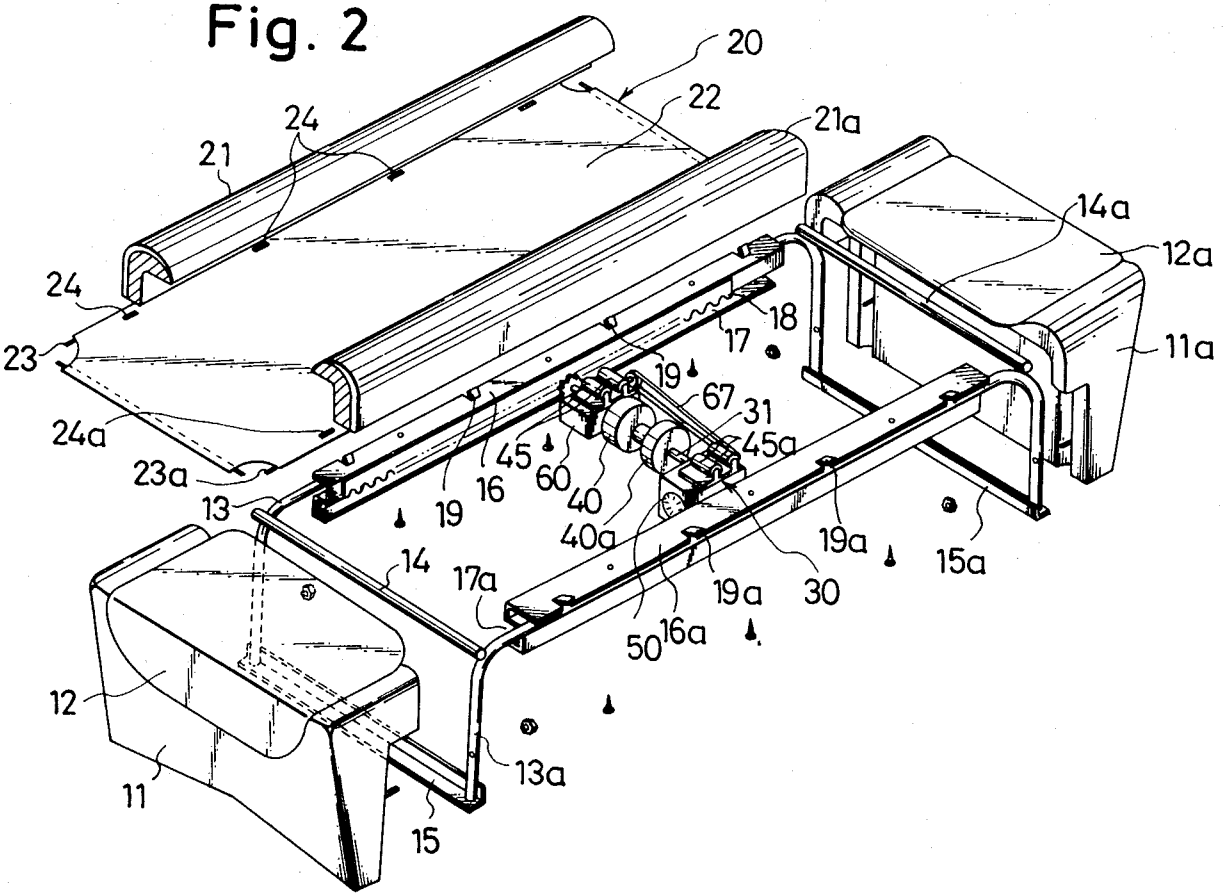
FIG. 2 is a perspective view as disassembled of respective main components of the massaging device of FIG. 1.
Figure 3:
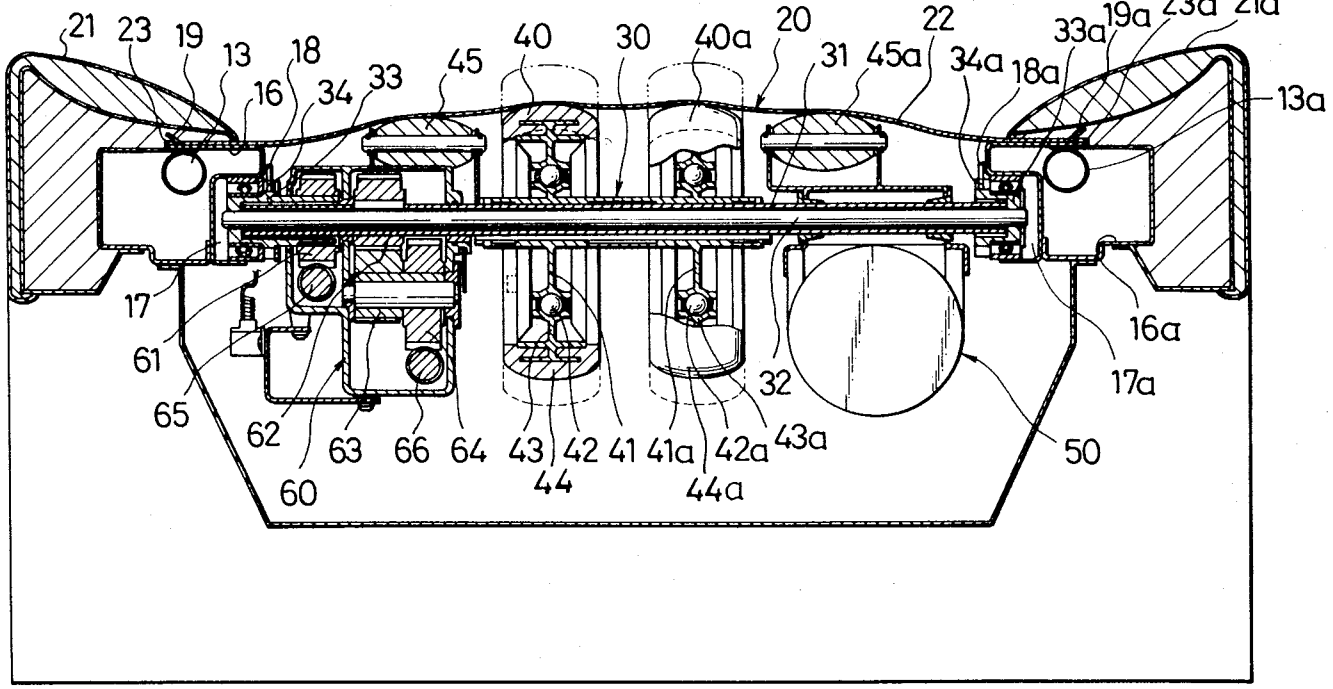
FIG. 3 is a transversely sectioned view of the massaging device of FIG. 1 along line III—III.

The massaging device shown in FIGS. 1 to 3 is disclosed in detail in the foregoing U.S. Pat. No. 4,412,534 (or French Appln. No. 8108583) and it may suffice the purpose to explain here just as summarized. Referring to the drawings, a massaging device 10 of elongated bed type comprises a pair of base members 11 and 11*a* carrying on their upper surface cushions 12 and 12*a* and fastened respectively to each end portion of a pair of long and reverse U-shaped frame members 13 and 13*a* arranged in parallel with each other. The frame members 13 and 13*a* are joined at the end portions by means of upper and bottom end bars 14, 14*a* and 15, 15*a* as reinforced by welding or the like. Guide rails 16 and 16*a* are screwed respectively to each horizontal part of the frame members 13 and 13*a* and are provided respectively with a guide channel 17 or 17*a* opened inward to oppose each other. Racks 18 and 18*a* are arranged adjacent the guide channels 17 and 17*a*.

Further, a plurality of hooks 19 and 19*a* for hanging a cover 20 are cut and raised on the upper surface of the guide channels 17 and 17*a*. The cover 20 is provided with side base members 21 and 21*a* arranged parallely in the lengthwise direction and covered with, for example, an urethane resin and cloth. A sheet member 22 is stretched between the both side base members 21 and 21*a*, as provided at respective side edge parts and with reinforcing bars 23 and 23*a* and adjacent thereto with slots 24 and 24*a* engageable with the hooks 19 and 19*a* so that the cover 20 can be mounted to the frame members 13 and 13*a* by engaging the slots to the hooks.

On the other hand, a moving massager assembly 30 is mounted across the guide rails 16 and 16*a* to be movable in the lengthwise directions of the rails. The assembly 30 comprises a main shaft 31 through which a driving shaft 32 is concentrically and axially rotatably passed, rollers 33 and 33*a* provided at the respective end parts of the driving shaft to be rollable within the guide channels 17 and 17*a* of the guide rails, pinions 34 and 34*a* a meshing respectively with the racks 18 and 18*a* in the guide channels 17 and 17*a* and integrally fixed respectively to the rollers 33 and 33*a*, a pair of massaging elements 40 and 40*a* fixed as properly separated from each other to the substantially middle part of the main shaft 31, a reversible motor 50 mounted on one end side of the main shaft 31, and a gear box 60 mounted on the other end side also of the main shaft.

The massaging elements 40 and 40*a* respectively comprise an inner ring 41 or 41*a* coupled eccentrically to the main shaft 31 and an outer ring 43 or 43*a* mounted on the periphery of the inner ring through ball bearing 42 or 42*a* and having soft material layer 44 or 44*a* attached to the peripheral surface of the outer ring. Auxiliary roller 45 and 45*a* respectively made in a pair are borne rotatably respectively on the upper surfaces of the motor 50 and gear box 60.

The gear box 60 contains a gear 61 made integral with the roller 33 at one end of the driving shaft 32, an elliptic gear 62 integral with the main shaft 31 and a gear 64 integral with an elliptic gear 63 meshing with the elliptic gear 62. A worm 65 is meshed with the gear 61 operatively coupled to the driving shaft 32, and another worm 66 is meshed with the gear 64 operatively coupled to the main shaft 31. In the present instance, the worms 65 and 66 are connected with each other through such sun-and-planet gear including an antifriction bearing as described in the above referred U.S. patent application Ser. No. 257,003 or French patent application No. 8108583, and are provided so that only one of the worms 65 and 66 can be selectively operated by, for example, operating a solenoid provided to oppose each of the worms 65 and 66 to brake the rotation of either one of the worms. The driving force for the main shaft 31 and driving shaft 32 is given through a belt 67 stretched between pulleys attached respectively to the output shafts of the motor 50 and worm 65.

When the motor 50 is driven by operating a switch 70 in the above described massaging device, the worm 65 is rotated through the belt 67. If the solenoid opposing the worm 65 is inoperative, the driving shaft 32 connected with the gear 61 is rotated through the worm 65 and, therefore, while the pinions 34 and 34*a* mesh respectively with the racks 18 and 18*a*, the massager assembly 30 will move in the lengthwise directions of the guide rails 16 and 16*a*, that is, the entire assembly 30 will advance or retreat along the guide rails 16 and 16*a* depending on the rotated direction of the reversible motor 50. If a human body is laid on the device between the base members 11 and 11*a*, the outer rings 43 and 43*a* of the massaging elements 40 and 40*a* will abut the back of the human body and their rotation will be substantially blocked by the weight of the human body but the inner rings 41 and 41*a* will eccentrically rotate with the main shaft 31 rotated and, therefore, a pressing action made strong and weak depending on variations in the eccentric projection of the elements can be given through the outer rings to the human body substantially over the length of his back. When the solenoid opposing the worm 65 is made operative on the other hand, the driving force of the motor 50 is transmitted ot the worm 66 through the sun-and-planet gear, so that the main shaft 31 will be rotated through the gears 64, 63 and 62 and, as the main shaft 31 and driving shaft 32 are relatively rotatable, the assembly 30 will not be moved and only the massaging elements 40 and 40*a* will rotate with the main shaft 31 to perform the pressing action at a fixed position of the driving shaft 32 with respect to the guide rails. In other words, as the worms are selectively rotated, for example, the entire back or a restrictive desired portion of the back of the human body can be selectively massaged.

Figure 4:
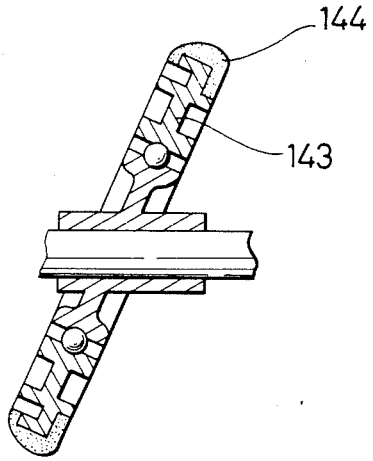
Fig. 4 (PRIOR ART)
FIG. 4 is a view sectioned diametrally on the axial direction of a conventional disk-shaped massaging element.
Figure 5:
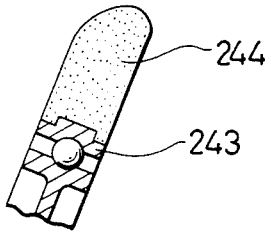
Fig. 5 (PRIOR ART)
FIG. 5 is a fragmental section also in the same diametral direction of another conventional massaging element.

However, as briefly referred to before, in the massaging element of such massaging device as shown, for example, in FIG. 4 (substantially irrespective of that the elements shown in FIG. 3 are not inclined with respect to the main shaft in contrast to those in FIG. 4), a soft material layer 144 fitted to be thin to the peripheral surface of an outer ring 143 will not be able to be soft enough for the human body but will provide a rather rigid or tough touch to the human body. On the other hand, in an event of a soft material layer 244 fitted to be considerably thick on the peripheral surface of an outer ring 243 as in FIG. 5, contrarily to the above, the touch will be too soft to provide a pressing force effective enough as the massaging action.

Figure 8:
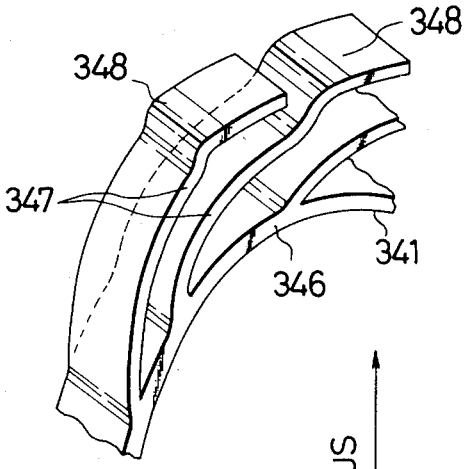
FIG. 8 is a fragmental perspective view of an elastic plate spring parts of the massaging element shown in FIG. 6.

According to an aspect of the present invention, the foregoing problem is solved by forming the outer ring itself of the massaging element in such a structure that will be soft or highly resilient in the initial stage of a compression between the shaft 31 and the human body but will become gradually remarkably harder when the compression is continuously increased, that is, the modulus of elasticity will increase. Referring more in detail to the particular aspect with reference to FIGS. 6 to 8, a massaging element 340 according to the present invention comprises an inner ring 341 eccentrically secured to a main shaft 331 (corresponding to the shaft 31 in FIGS. 1 to 3) and an outer ring 343 of a unique formation arranged around the inner ring 341 through a ball bearing 342 to be rotatable relative to the inner ring.

Further, the outer ring 343 comprises a ring body 346 and a plurality of plate spring parts 347 formed integrally with the ring body 346 and extending radially outward from its periphery but with an acute angle thereto (to extend clockwise in FIG. 7) substantially to be spiral, so as to provide a proper elasticity against radial compression. Preferably, the ring body 346 and spring parts 347 are made of the same material as the inner ring 341, such as a polyacetal resin. Further, the spring parts 347 are respectively formed in an arcuate shape including an elevated part 348 slightly projecting radially outward at an outer portion adjacent the free end than the middle part. In this case, the free end of each plate spring part 347 is made to extend to a position close to the elevated part 348 of an adjacent one of the spring parts 347 as seen best in FIG. 7. Further, the outer ring 343 is provided with a soft material layer 344 formed around the ring so as to embed therein and to extend radially outward the respective spring parts 347, as rounded at the outer peripheral edges to be substantially triangular in the cross-section at the outer peripheral part. The layer 344 is formed of such material showing a sufficient elasticity as, for example, rubber or a soft vinyl chloride resin and is made integral with the outer ring 343, while leaving hollow spaces 349 each having a substantially triangular cross-section having an apex adjacent the elevated part 348 most separating the adjacent spring part 347 from each other and long in the bottom side. In such formation, the plate spring part 347 provides a modulus of elasticity larger than that of the soft material layer 344.

Now, in the case where the massaging elements according to the present invention are applied to such massaging device as shown in FIGS. 1 to 3, on the cover 20 of which a human body is laid in the longitudinal direction of the device, and the massager assembly 30 carrying the massaging elements 340 is moved to advance and retreat, the outer rings 343 of the massaging elements will roll relatively by several rotations following the movements of the massager assembly 30 but will not follow the rotation of the main shaft 331 due to the load of the human body imparted to the elements. That is, substantially only the inner ring 341 secured to the main shaft 331 will eccentrically rotate within the outer ring 343 through the ball bearing 342 and, therefore, the elements as a whole will be displaced at the outermost edge with respect to the main shaft 331 between the maximum projecting position shown by dotted lines in FIG. 3 and the minimum projecting position shown by solid lines and will intermittently make a so-called pressing massage for the human body.

Figure 9:
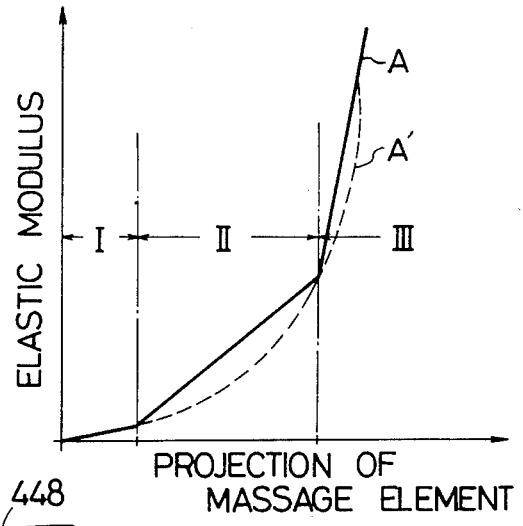
FIG. 9 is a diagram showing relative characteristics of the elastic modulus to projections at the outermost end of the massaging element of FIG. 6 with respect to its eccentrical supporting shaft.

Referring now to FIG. 9, in the initial stage where the projection of the massaging elements 340 is of the minimum under the load applied to them by the human body, mostly the top portion only of the soft material layer 344 which is relatively small in the elastic modulus is compressed so that the hardness or the pressing force of the elements provided to the human body will be so slight as to be felt soft, as seen in a zone I of the curve shown in FIG. 9. Then, as the projection of the elements 340 increases with the rotation of the main shaft 331, the plate spring parts 348 start to be depressed to approach each other while compressing the space 349 positioned between them and, therefore, as shown by a next zone II in FIG. 9, the elastic modulus becomes larger and the pressing force for the human body gradually increases. At this time, a proper extent of the space 349 is left between the respective spring parts 347 so that the soft material lay 344 may not perfectly charge between the respective spring parts, the increase of the hardness, that is, the elastic modulus in the zone II can be made optimum. Further, when the plate spring parts 347 approach each other so closely that the space 349 will be substantially perfectly compressed, the elastic modulus will increase sharply as shown in a further zone III so as to provide a perfectly hard touch or the maximum pressing force to the human body. Therefore, the massaging element 340 according to the present invention has three zones of different moduli of elasticity as a whole as shown by the curve of solid line A in FIG. 9 and can give such optimum pressing force very similar to that of a manual massaging as shown by a curve of dotted line A' in the drawing.

Here, it will be easily understood by one skilled in the art that, if a substantially radially inwardly extending projection (while not illustrated) is provided in the foregoing embodiment to project on the lower surface of the free end part of the respective plate spring parts 347, the zone III in FIG. 9 can be obtained earlier due to variations in the modulus of elasticity in the zone II.

Figure 10:
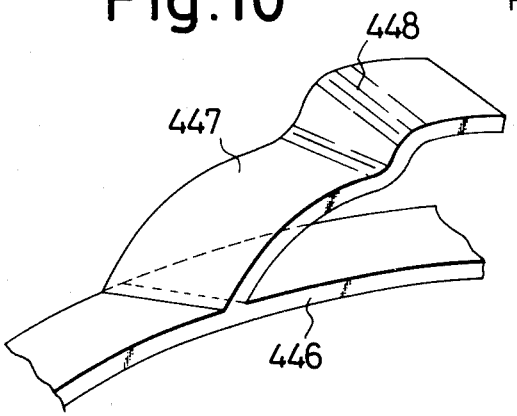
FIG. 10 is a fragmental perspective view of one of elastic plate spring parts in another embodiment of the massaging element according to the present invention.

Further, according to another aspect of the present invention, the massaging element is formed to cushion a force applied to the element in the axial direction of the main shaft. Referring to FIG. 10, each plate spring part 447 of the outer ring is made integral with a ring body 446 at an angle with the axial direction thereof and, in particular, the part between the base of the plate spring part 447 and its elevated part 448 is slightly twisted and curved with respect to the periphery of the ring body 446. When this twisted and curved surface is made to face the direction in which the load of the human body or the like is applied, the plate spring part 447 will smoothly curve without being subjected to any excess load upon the application of load and, in addition to the characteristics shown in FIG. 9, the spring parts 447 increase in the durability. Also, in an event when a neck or the like part of the human body is held between the massaging elements, any excesively large force can be prevented from being applied to the neck.

It should be also understood that the massaging element shown in FIGS. 6 to 8 or 10 can be arranged in a pair properly separated from each other in such massaging device as, for example, in FIGS. 1 to 3 and that, particularly, the pair of such elements as shown in FIG. 10 will be so arranged that the plate spring part 447 having the twisted surface will be symmetrical with respect to the vertical plane passing through the middle portion of the main shaft. Further, more than the three zones of different moduli of elasticity can be set by slightly modifying the plate spring part or enlarging the hollow space.

According to the massaging element of the present invention formed as described above, different moduli of elasticity are effectively realized as divided in several soft to hard steps, so that an optimum pressing force can be provided while the massaging touch given to the human body is kept favorable and thus a pressing force similar to the ideal pressing force by a skilled massagist can be mechanically given to the human body.

What is claimed as our invention is:

1. A massaging element of a massaging device including an outer ring mounted through an antifriction bearing concentrically around an inner ring secured eccentrically to a driven shaft and an elastic member fitted peripherally around said outer ring, wherein said elastic member of said outer ring comprising a plurality of components showing different moduli of elasticity in the direction in which a load is applied, whereby, upon a pressing massage operation for a human body, a nonlinear characteristic curve of the modulus of elasticity which thus increasing stepwise is achieved by the entire elastic member, said components of said elastic member comprise a plurality of elastic plate spring parts integral with a ring body of said outer ring and extending radially out of said body so that at least adjacent ones of said plate spring parts will partly overlap each other in the direction of said load, and a soft material layer formed at least partly between the respective plate spring parts and peripherally around the plate spring parts, said layer being smaller in modulus of elasticity than that of the plate spring parts.

2. A massaging element according to claim 1 wherein said respective elastic plate spring parts are formed substantially in an arcuate shape.

3. A massaging element according to claim 1 wherein said plate spring parts respectively have an intermediate elevated part extending radially outward with respect to said ring body and a free end reaching close to said elevated part of an adjacent one of the spring parts, said soft material layer defines therein a hollow space between respective adjacent ones of the plate spring parts, said space being substantially of a triangular cross-section having an apex positioned adjacent said elevated part of each plate spring part, whereby said nonlinear characteristic curve of the entire elastic member is made to include three zones, a first small elastic modulus zone of which being provided by the outer peripheral part of the soft material layer, a second medium elastic modulus zone of which being provided by the respective plate spring parts and spaces between them and a third large elastic modulus zone of which being provided by the respective plate spring parts caused to be overlapped with the compressed soft material and spaces interposed between them.

4. A massaging element according to claim 1 wherein said elastic plate spring parts are respectively made at their base part to be integral with said ring body of said outer ring at an angle with respect to the axial direction of the ring and to be curved as relatively slighly twisted toward the direction in which said load is applied.

* * * * *